US008776329B2

(12) United States Patent
Kapadia

(10) Patent No.: US 8,776,329 B2
(45) Date of Patent: Jul. 15, 2014

(54) FASTENER APPARATUS

(76) Inventor: Jay R. Kapadia, Hackensack, NJ (US)

( * ) Notice: Subject to any disclaimer, the term of this patent is extended or adjusted under 35 U.S.C. 154(b) by 243 days.

(21) Appl. No.: 12/802,124

(22) Filed: May 28, 2010

(65) Prior Publication Data

US 2011/0289734 A1 Dec. 1, 2011

(51) Int. Cl.
*A41B 1/10* (2006.01)
*A41B 1/18* (2006.01)

(52) U.S. Cl.
USPC ..... 24/379.1; 24/90.1

(58) Field of Classification Search
CPC ..... A44B 1/20
USPC ..... 24/113 MP, 113 R, 114.7, 379.1, 700, 24/90.1; 2/265, 266
See application file for complete search history.

(56) References Cited

U.S. PATENT DOCUMENTS

| | | | | | |
|---|---|---|---|---|---|
| 1,943,885 | A | * | 1/1934 | Blue | 2/115 |
| 2,072,218 | A | * | 3/1937 | Richardson | 44/643 |
| 2,166,328 | A | * | 7/1939 | Spatz | 2/269 |
| 2,801,421 | A | * | 8/1957 | Marin | 2/70 |
| 2,939,191 | A | * | 6/1960 | Emsig | 24/114.7 |
| 3,286,277 | A | * | 11/1966 | Weiss | 2/115 |
| 4,333,182 | A | * | 6/1982 | Seibt | 2/265 |
| 4,580,320 | A | * | 4/1986 | Takata | 24/113 MP |
| 5,353,438 | A | * | 10/1994 | Voiles | 2/145 |
| 5,379,888 | A | * | 1/1995 | Rentos | 206/265 |
| 5,671,507 | A | | 9/1997 | Deschenes et al. | |
| 5,911,312 | A | * | 6/1999 | Holyfield | 2/69 |
| 5,938,025 | A | * | 8/1999 | Chernack | 206/348 |
| 5,956,816 | A | * | 9/1999 | McCrink | 24/113 MP |
| 6,003,209 | A | | 12/1999 | Oh et al. | |
| 6,081,926 | A | * | 7/2000 | Krause et al. | 2/129 |
| 6,163,938 | A | | 12/2000 | Weber-Unger | |
| 6,401,254 | B1 | | 6/2002 | Boller | |
| 2002/0040492 | A1 | | 4/2002 | Tsuruta | |
| 2003/0192154 | A1 | | 10/2003 | Okun | |
| 2010/0199461 | A1 | | 8/2010 | Usui et al. | |

FOREIGN PATENT DOCUMENTS

| | | |
|---|---|---|
| EP | 2100530 A1 | 9/2009 |

* cited by examiner

*Primary Examiner* — Robert J Sandy
*Assistant Examiner* — Louis Mercado

(57) ABSTRACT

A material fastener apparatus having one or more buttons which are attached to a first section of the material. The apparatus may have a layer of stretchable material which may be positioned under the first section of the material. The apparatus may also have one or more button holes which are attached to a second section of the material. The one or more button holes may be angled to the horizontal and are configured to receive the one or more buttons. The button holes may also be further configured to fasten the first section of the material with a second section of the material when the one or more buttons are buttoned with the one or more button holes.

18 Claims, 1 Drawing Sheet

FASTENER APPARATUS

FIELD OF THE INVENTION

The present invention is generally related to an apparatus for fastening sections of material used in clothing, home textiles, leather, knit or woven products, or the like.

BACKGROUND OF THE INVENTION

Sections of material such as those used in clothing, home textiles, leather, knit or woven products etc. are normally fastened together using a button in conjunction with a button hole configuration. The buttons in these configurations are normally attached or sewn in position onto the material using rigid thread. This normally fixes the button in place with little or no movement. Movement may be required in order to insert the button into the button hole on another section of the clothing, home textiles, leather, knit or woven products products/material. However, this movement may be constrained by way of the rigid thread and as a result, users may have to pull on the button which ultimately would lead to a weakening of the attached thread. Pulling on the button may also lead to a loosening of the knot (which affixes the button in place) and the subsequent loss of the button, immediately or after continued use, as it falls off from the loosened knot. In addition, elderly or disabled individuals generally have difficulty grasping small objects including buttons, thereby making the buttoning process difficult. This problem may be further exacerbated by health conditions such as arthritis in which case fastening a button may result in pain for the arthritis sufferer.

In light of these problems, there exists a need for an apparatus designed to ease the fastening process for clothing, home textiles, leather, knit or woven products/material. There also exists a need for an apparatus that reduces or eliminates the pain normally suffered by disabled individuals when they are buttoning their garments or apparel.

SUMMARY OF THE INVENTION

In light of the foregoing problems, it is an object of the present invention to provide an apparatus for fastening material such as clothing, home textiles, leather, knit or woven products or sections thereof. In one aspect of an embodiment of the present invention, the apparatus may comprise of one or more buttons. The one or more buttons may be attached to a first section of the material. The apparatus may also comprise of a layer of stretchable material which may be positioned under the first section of the material. This layer of stretchable material may be sewn to the one or more buttons. The apparatus may also comprise of one or more button holes which are attached to a second section of the material. The button holes may be configured to receive the one or more buttons and they may also be further configured to fasten the first section of the material with the second section of the material when the one or more buttons are buttoned onto the button holes. The one or more button holes may be angled to the horizontal.

In another aspect of an embodiment of the present invention, the one or more button holes may be angled or set to the horizontal at an angle of less than 90 degrees or at an angle that is more than 90 degrees but less than 180 degrees. In another aspect of an embodiment of the present invention.

It is another object of the present invention to provide a fastening apparatus where the one or more buttons is/are fastened to a first section of material by stretchable thread. In another aspect of the present invention, the one or more buttons may be fastened to both the first section of material and a layer of stretchable material which is positioned under the first section of material.

It is another object of the present invention to provide a fastening apparatus where the one or more buttons is/are coated with a rubberized coating to increase the friction needed for gripping the one or more buttons.

It is another object of the present invention to provide a fastening apparatus where the one or more buttons is/are made of a rough surface for increasing the friction required to ease gripping of the one or more buttons. In another aspect of an embodiment of the present invention, the button may be etched with grooves to further enable the grip of a user. In another aspect of an embodiment of the present invention, the button may be molded with a raised lip around the button's periphery.

It is yet another object of the present invention to provide a fastening apparatus where the fastening apparatus may comprise of one or more buttons, where the one or more buttons may be attached to a first section of the material. The one or more buttons may be attached to the first section of the material by elastic thread. The apparatus may further comprise of one or more button holes which are attached to a second section of the material. The one or more button holes may be configured to receive the one or more buttons and fasten the first section of the material with the second section of the material when the one or more buttons is received or buttoned with the button holes. The one or more button holes may be set or angled to the horizontal.

In one aspect of an embodiment of the present invention, the button hole may be angled to the horizontal at an angle of either less than 90 degrees or more than 90 degrees but less than 180 degrees. In another aspect of an embodiment of the present invention, the one or more buttons may be attached to a first section of the material. In another aspect of an embodiment of the present invention, the one or more buttons may be attached using elastic or stretchable thread.

It is yet another object of the present invention to provide a fastening apparatus for fastening material where the apparatus comprises of one or more one buttons, where the one or more one buttons may be attached to a first section of the material. The one or more one buttons may be attached to the first section of the material by an elastic thread. The apparatus may also comprise of a layer of stretchable material, which may be positioned below or under the first section of material and sewn to the one or more one buttons. The apparatus may further comprise of one or more one button holes, each configured to receive the one or more buttons and each attached to a second section of the material. The one or more button holes fasten the first and second sections of the material when the button is received or buttoned with the button holes. In one aspect of an embodiment of the present invention, the button holes may be set at an angle to the horizontal.

In another aspect of an embodiment of the present invention, the one or more button holes may be angled to the horizontal at an angle of either less than 90 degrees or at an alternate angle that is more than 90 degrees but less than 180 degrees.

BRIEF DESCRIPTION OF THE DRAWINGS

The features and advantages of aspects of the present invention will become more apparent from the detailed description set forth below when taken in conjunction with the claims and drawings, in which like reference numbers indicate identical or functionally similar elements. Additionally, the left-most digit of a reference number identifies the drawing in which the reference number first appears.

Referring now to FIG. 1A, a plan view of a first section 100 of a fastening apparatus with a button 102 attached to material 104 according to an exemplary aspect of the present invention is shown. Button 102 is fastened or affixed to material 104 by way of thread 110. In one aspect of an embodiment of the present invention, thread 110 may be made of stretchable material such as polyurethane or any other elastic/stretchable known in the field which will enable button 102 to be extended further away from material 104 when a user attempts to button the material with another section. It should be noted that button 102 may be of any shape or form including, without limitation, triangular, rectangular, square, etc.

Referring now to FIG. 1B, a plan view of a first section 100 of a fastening apparatus with a button 102 attached to material 104 and a layer of stretchable material 112 according to another exemplary aspect of the present invention. Here, button 102 is fastened or affixed to material 104 and stretchable material 112 by way of thread 110. In one aspect of an embodiment of the present invention, thread 110 may be made of stretchable material such as an elastic fiber which will enable button 102 to be extended further away from material 104 when a user attempts to button the material with another section of the material 104. Stretchable material 112 also enables further pull or extension of button 102 when a user is buttoning first section 100 with another section of material. In another aspect of an embodiment of the present invention, thread 110 may be made of cotton wrapped in polyurethane. In another aspect of an embodiment of the present invention, thread 110 may be made of 100% polyester or 100% cotton or a polyester-cotton blend wrapped around a polyurethane core. In another aspect of an embodiment of the present invention, thread 110 may be any fiber wrapped around a polyurethane core.

Stretchable material 112, in one aspect, may be woven or non-woven interlining made of yarns which can stretch in either of the warp, weft or both warp and weft directions.

In another aspect of an embodiment of the present invention, button 102 may be attached to stretchable woven or non interlining which may be fused or non-fused. This would allow button 102 to even greater extension from its normal position.

In another aspect of an embodiment of the present invention, button 102 may be covered by a coating 108 of easy grip material to enhance a user's ability to grip and fasten button 102. In yet another aspect of the present invention, button 102 may have etchings on its face and body to increase friction between button 102 and a user's fingers. This would also further enhance a user's grip on button 102 whilst buttoning sections of material. In a yet further aspect of the present invention, button 102 may be coated with polyester resin to increase the friction required to ease grabbing of button 102.

Figure 1A:
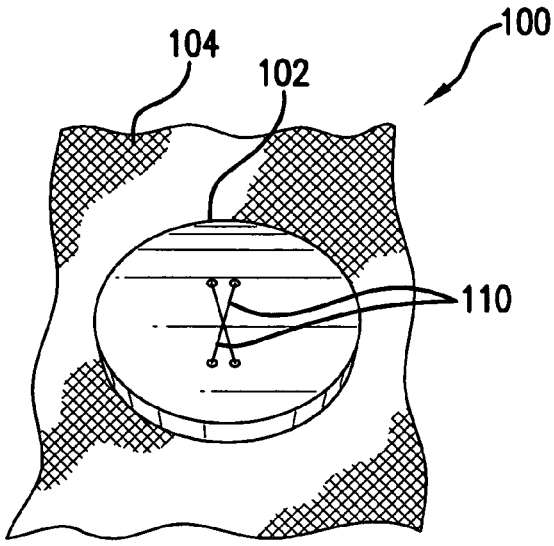
FIG. 1A illustrates a plan view of a first section of a fastening apparatus with a button attached to a section of material according to an exemplary aspect of the present invention.
Figure 1B:
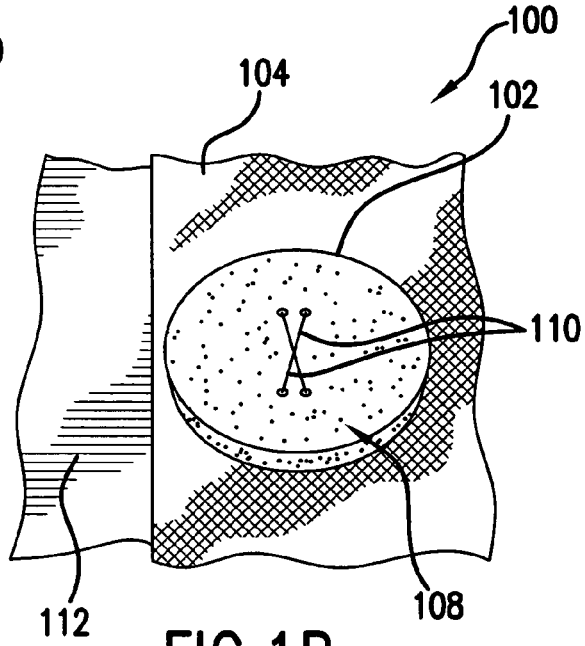
FIG. 1B illustrates a plan view of a first section of a fastening apparatus with a button attached to a section of material and a layer of stretchable material according to another exemplary aspect of the present invention.
Figure 1C:
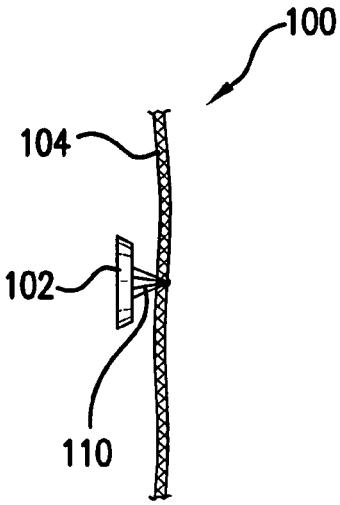
FIG. 1C illustrates a side view of a first section of a fastening apparatus with a button attached to a section of material according to an exemplary aspect of the present invention.

Referring now to FIG. 1C, a side view of a first section 100 of a fastening apparatus with button 102 attached to material 104 according to an exemplary aspect of the present invention. Here, as in FIG. 1A, button 102 is fastened or affixed to material 104 by way of thread 110. In one aspect of an embodiment of the present invention, thread 110 may be made of stretchable material such as polyurethane or any other elastic/stretchable known in the field which will enable button 102 to be extended further away from material 104 when a user attempts to button the material with another section of the material 104.

Figure 1D:
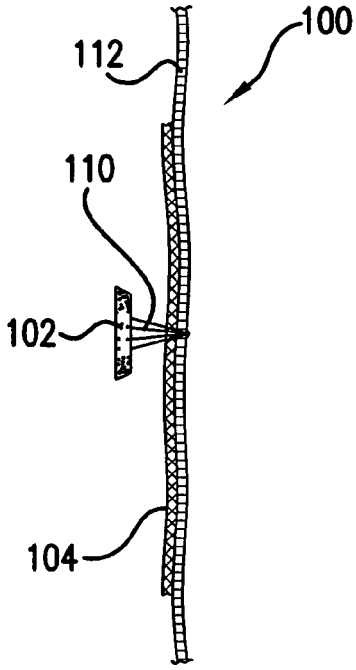
FIG. 1D illustrates a side view of a first section of a fastening apparatus with a button attached to a section of material and a layer of stretchable material according to another exemplary aspect of the present invention.

Referring now to FIG. 1D, a side view of a first section 100 of a fastening apparatus with a button attached to material and a layer of stretchable material according to another exemplary aspect of the present invention. Here, as in FIG. 1B, button 102 is fastened or affixed to material 104 and stretchable material 112 by way of thread 110. In one aspect of an embodiment of the present invention, thread 110 may be made of stretchable material such as polyurethane or any other elastic/stretchable known in the field etc. which will enable button 102 to be extended further away from material 104 when a user attempts to button the material with another section of the material 104. Stretchable material 112 also enables further pull or extension of button 102 when a user is buttoning material section 104 with another section of material. Stretchable material 112 and thread 110 (when, in one aspect, it is made of stretchable material) enable the button 102 to return to its original position after the user un-buttons button 102.

Figure 2:
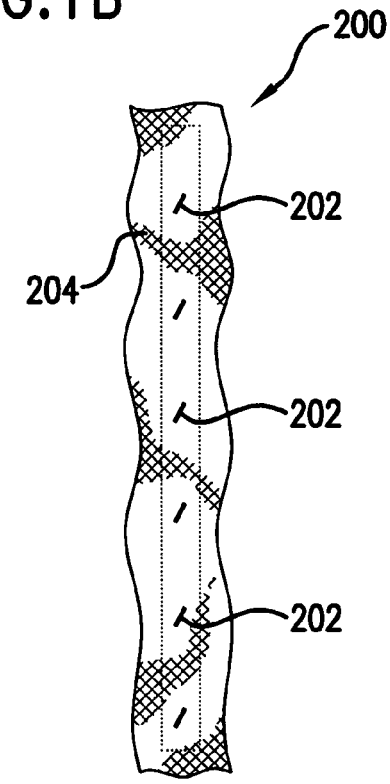
FIG. 2 illustrates a plan view of a second section of a fastening apparatus having a plurality of button holes according to yet another exemplary aspect of the present invention.

Referring now to FIG. 2, a plan view of a second section 200 of a fastening apparatus having a plurality of button holes according to yet another exemplary aspect of the present invention. Second section 200 comprises of one or more button holes 202 which are cut out of material section 204. Material section 204 may be made of the same material as with material section 104. As seen in FIG. 2, one or more button holes 202 are aligned along a first or vertical axis which is in the same plane as section 204. As shown, one or more button holes 202 are seen to be angled when measured from a second or horizontal axis, where this second or horizontal axis is perpendicular to the vertical axis of one or more button holes 202 and in the same plane as section 204. In one aspect of the present invention, button hole 202 may be angled at an angle that is greater then 0 but less than 90 degrees. In another aspect of the present invention, button hole 202 may be angled at an angle that is greater than 90 degrees by less than 180 degrees when measured from the horizontal. The angling helps ease the buttoning process by a user.

In buttoning, a user seeking to fasten first section 100 with second section 200 would grip or grab button 102 and insert it into one of button holes 202. Button hole 202's angular configuration eases the buttoning process as in one aspect button hole 202 is angled towards the point of entry/insertion of button 102. Also, the angular slant of button hole 202 eases the buttoning process as both sections of the material i.e. first section 100 and second section 200, may not be exactly aligned when a user is about the button both sections together Upon un-buttoning, button 102 is returned or retracted to its original position by way of thread 110 (where thread 110 is made of stretchable material) and/or stretchable material 112. This enables a user to extend button 102 as need be while not loosening thread 110 and subsequently losing button 102. In one aspect of an embodiment of the present invention, button hole 202 may be ringed by elastic material or stretchable material to allow button hole 202 to expand to ease the insertion of button 102.

Although this present invention has been disclosed with reference to specific forms and embodiments, it will be evident that a great number of variations may be made without departing from the spirit and scope of the present invention. For example, steps may be reversed, equivalent elements may be substituted for those specifically disclosed and certain features of the present invention may be used independently of other features—all without departing from the present invention as defined in the appended claims.

What is claimed is:

1. A fastening apparatus for fastening sections of material, comprising:

at least one button, wherein said at least one button is attached to a first section of said material, wherein said first section is a section of the material being fastened;

a layer of stretchable material, under said first section of said material sewn to said at least one button; and, at least two button holes, wherein a first and a second of said at least two button holes are each configured to receive said at least one button and further configured to fasten said first section of said material with a second section of said material when said button is received, said first and second button holes being axially aligned with each other along a first axis, wherein said first axis lies within a plane as with said second section of said material, wherein said first and second button holes are angled at an angle other than 0, 90 and 180 degrees measured from a second axis which lies within the plane of said first axis, said second axis being perpendicular to said first axis and wherein said at least two button holes are attached to said second section of said material, wherein said second section is a section of the material being fastened.

2. The fastening apparatus of claim 1 wherein said at least two button holes are angled at an angle of more than 0 degrees but less than 90 degrees to said second axis.

3. The fastening apparatus of claim 1 wherein said at least two button holes are angled at an angle of more than 90 degrees but less than 180 degrees to said second axis.

4. The fastening apparatus of claim 1, wherein said at least one button is fastened to said first section of material by stretchable thread.

5. The fastening apparatus of claim 1 wherein said button is coated with a rubberized coating to enhance friction needed for grabbing said button.

6. The fastening apparatus of claim 1, wherein said button is made of a rough surface for increasing friction required to ease grabbing of said button.

7. A fastening apparatus for fastening sections of material, comprising:

at least one button, wherein said at least one button is attached to a first section of said material, wherein said at least one button is attached to said first section of said material by elastic thread, wherein said first section is a section of the material being fastened; and at least two button holes, wherein a first and a second of said at least two button holes are each configured to receive said at least one button and fasten said first section of said material with a second section of said material when said at least one button is received, said first and second button holes being axially aligned with each other along a first axis, wherein said first axis lies within a plane as with said second section of said material, wherein said first and second button holes are angled at an angle other than 0, 90 and 180 degrees when measured from a second axis which lies within the plane of said first axis, said second axis being perpendicular to said first axis and wherein said at least two button holes are attached to said second section of said material and wherein said second section is a section of the material being fastened.

8. The fastening apparatus of claim 7 wherein said at least two button holes are angled at an angle of more than 0 degrees but less than 90 degrees to said second axis.

9. The fastening apparatus of claim 7 wherein said at least two button holes are angled at an angle of more than 90 degrees but less than 180 degrees to said second axis.

10. The fastening apparatus of claim 7, wherein said at least one button is fastened to said first section of material by stretchable thread.

11. The fastening apparatus of claim 7 wherein said button is coated with polyester resin to enhance friction needed for grabbing said button.

12. The fastening apparatus of claim 7, wherein said button is made of a rough surface for increasing friction required to ease grabbing of said button.

13. A fastening apparatus for fastening sections of material, comprising:

at least one button, wherein said at least one button is attached to a first section of said material, wherein said at least one button is attached to said first section of said material by elastic thread, wherein said first section is a section of the material being fastened;

a layer of stretchable material, sewn to said at least one button; and at least one button hole, configured to receive said at least one button and fasten said first section of said material when said at least one button is received, wherein said at least one button hole is attached to a second section of said material, said second section of said material being a section of the material being fastened, and wherein said at least one button hole is axially aligned along a first axis wherein said first axis lies within a plane as with said second section of said material and said at least one button hole is angled at an angle other than 0, 90 and 180 degrees measured from a second axis which also lies within the plane of said first axis and wherein said second axis is perpendicular to said first axis.

14. The fastening apparatus of claim 13 wherein said at least one button hole is angled at an angle of more than 0 degrees but less than 90 degrees to said second axis.

15. The fastening apparatus of claim 13 wherein said at least one button hole is angled at an angle of more than 90 degrees but less than 180 degrees to said second axis.

16. The fastening apparatus of claim 13, wherein said at least one button is fastened to said first section of material by stretchable thread.

17. The fastening apparatus of claim 13 wherein said button is coated with polyester resin to enhance friction needed for grabbing said button.

18. The fastening apparatus of claim 13, wherein said button is made of a rough surface for increasing friction required to ease grabbing of said button.

* * * * *